US011359343B2

(12) United States Patent
Rupp et al.

(10) Patent No.: US 11,359,343 B2
(45) Date of Patent: Jun. 14, 2022

(54) CONTROL APPARATUS FOR SOIL COMPACTING APPARATUS, WITH HANDLEBAR AND ROTATIONAL SPEED LEVER

(71) Applicant: Wacker Neuson Produktion GmbH & Co. KG, Reichertshofen (DE)

(72) Inventors: Ferdinand Rupp, Munich (DE); Alexander Huber, Vohburg (DE)

(73) Assignee: Wacker Neuson Produktion GmbH & Co. KG, Reichertshofen (DE)

( * ) Notice: Subject to any disclaimer, the term of this patent is extended or adjusted under 35 U.S.C. 154(b) by 58 days.

(21) Appl. No.: 16/839,612

(22) Filed: Apr. 3, 2020

(65) Prior Publication Data

US 2020/0318309 A1 Oct. 8, 2020

(51) Int. Cl.

| | |
|---|---|
| ***E01C 19/40*** | (2006.01) |
| ***E02D 3/074*** | (2006.01) |
| ***G05G 1/01*** | (2008.04) |
| ***G05G 5/05*** | (2006.01) |

(52) U.S. Cl.

CPC ..... *E02D 3/074* (2013.01); *E01C 19/402* (2013.01); *G05G 1/01* (2013.01); *G05G 5/05* (2013.01); *E01C 2301/00* (2013.01); *G05G 2505/00* (2013.01)

(58) Field of Classification Search

CPC ... E01C 19/402; E01C 2301/00; E02D 3/074; G05G 1/01; G05G 5/05; G05G 5205/00; G05G 2505/00

USPC ..... 404/72–75, 113, 133.05–133.2

See application file for complete search history.

(56) References Cited

U.S. PATENT DOCUMENTS

| | | | | |
|---|---|---|---|---|
| 4,775,263 | A * | 10/1988 | Persson | E01C 19/35 404/133.1 |
| 7,753,621 | B2 * | 7/2010 | Steffen | E01C 19/38 404/133.1 |
| 8,047,742 | B2 * | 11/2011 | Sick | E02D 3/074 404/133.1 |
| 10,458,077 | B2 * | 10/2019 | Sorg | E01C 19/35 |
| 2018/0258601 | A1 * | 9/2018 | Rupp | E01C 19/38 |
| 2020/0318308 | A1 * | 10/2020 | Rupp | E02D 3/074 |
| 2020/0332481 | A1 * | 10/2020 | Hartmann | E01C 21/00 |

* cited by examiner

*Primary Examiner* — Raymond W Addie

(74) *Attorney, Agent, or Firm* — Boyle Fredrickson S.C.

(57) ABSTRACT

A control apparatus for a soil compacting apparatus which can be driven by a drive motor. The control apparatus includes a running-direction operating element, which is pivotable about a first axis, for predetermining a running direction of the soil compacting apparatus by an operator, and further includes a rotational-speed operating element, which is pivotable about a second axis, for setting a rotational speed of the drive motor. The first axis and the second axis are congruent and form a common pivot axis.

15 Claims, 3 Drawing Sheets

CONTROL APPARATUS FOR SOIL COMPACTING APPARATUS, WITH HANDLEBAR AND ROTATIONAL SPEED LEVER

BACKGROUND OF THE INVENTION

1. Field of the Invention

The invention relates to a soil compacting apparatus which can be driven by a motor.

2. Discussion of the Related Art

Hand-guided reversible vibratory plates (vibrating plates), in particular, are known as a soil compacting apparatus of this type. Vibratory plates conventionally have a soil contact plate, on which an unbalance exciter is mounted which, for example, has two unbalance shafts which can be rotated in opposite directions and can be set in opposed rotation by a drive, in particular a drive motor. By rotation of the unbalance shafts in the unbalance exciter, vibrations are generated which can be used for soil compacting in a known manner. The unbalance exciter is generally driven via a hydraulic system or by means of a belt drive.

A longitudinally extending drawbar is provided on the vibratory plate, at the end of which drawbar (drawbar head) a switchover handle or handlebar is provided, via which an operator not only can steer and guide the vibratory plate, but can also set the running direction of the vibratory plate. For this purpose, unbalance exciters are known, in which the relative phase position of the acting unbalance shafts with respect to one another can be changed, in order to change the direction of action of the resulting vibration vectors. The running direction of the vibratory plate can be determined depending on whether a resulting vibration vector is directed in the forward direction of travel or in the rearward direction of travel.

The handlebar belonging to a control apparatus for the vibratory plate is generally highly stable and makes it possible, on the one hand, for the operator to guide and to steer the vibratory plate. On the other hand, the switchover handle is designed as a large hand lever and can be pivoted relative to the drawbar head, to which it is fastened. By pivoting of the switchover handle relative to the drawbar head, a hydraulic signal is generated which can be transmitted to the unbalance exciter in the vibratory plate, in order, in a known manner, to define or to change the phase position of the unbalance shafts rotating counter to one another. The running direction of the vibratory plate can therefore be set with the aid of the switchover handle.

In addition to the switchover handle or handlebar for switching over the running direction, a hand lever can be provided for setting the rotational speed, with which the rotational speed of the drive motor can be set in a known manner. The hand lever is conventionally arranged on the lower side of the drawbar body or laterally on the drawbar head or drawbar body. Embodiments are also known, in which the hand lever (rotational speed lever, gas lever) is provided directly on the motor or on a protective frame of the vibratory plate.

Depending on the arrangement of the rotational speed lever, there may be problems with the accessibility thereof or capability of identifying its selected position and therefore rotational speed. If, for example, the rotational speed lever is arranged on the lower side of the drawbar body, the position of the rotational speed lever cannot be readily detected, especially during operation of the vibratory plate. The rotational speed lever may even be damaged by means of its exposed position, in particular when a drawbar is swung upward, during the transport or loading of the machine. This problem also exists if the rotational speed lever is fastened laterally to the drawbar head or to the drawbar body. If the rotational speed lever is arranged directly on the motor or on the protective frame of the vibratory plate, the distance between operator and rotational speed lever increases with an increasing machine size, which makes the operation more difficult and at any rate more uncomfortable.

SUMMARY OF THE INVENTION

The invention is therefore based on the object of specifying a control apparatus for a soil compacting apparatus, in which the operating element for setting the motor rotational speed (for example a rotational speed lever or hand lever) is arranged in a readily accessible and easily visible manner, while simultaneously being more protective against damage, in particular during loading and transport.

The object is achieved according to the invention by a control apparatus for a soil compacting apparatus which can be driven by a drive motor is specified. The control apparatus has a running-direction operating element, which is pivotable about a first axis, for predetermining a running direction of the soil compacting apparatus by an operator, and also has a rotational-speed operating element, which is pivotable about a second axis, for setting a rotational speed of the drive motor. The first axis and the second axis are congruent and form a common pivot axis.

The drive motor, for example an internal combustion engine or electric motor, is not part of the control apparatus. Rather, a control apparatus is specified which can be coupled to the drive motor.

A running-direction operating element can be, for example, a robust handlebar or a switchover handle, by means of the pivoting of which an unbalance exciter of the soil compacting apparatus (for example a vibratory plate) can be set in a known manner.

The rotational-speed operating element, for example a hand lever or a rotational speed lever, serves for controlling the motor and in particular for setting the motor rotational speed.

The two operating elements are arranged on the same common pivot axis and can be pivoted about the latter independently of each other, which permits a highly compact design.

The running-direction operating element and the rotational-speed operating element can be held by a control housing. The control housing here can in particular form part of a drawbar head which can be arranged at the end of a guide drawbar of a vibratory plate. The control housing can be designed in order to hold the bearing devices provided in each case optionally for the pivotability of the two operating elements.

A hydraulic connection device can be provided, to which hydraulic components of the soil compacting apparatus can be connected, wherein the running-direction operating element is coupled to a running-direction transmission device, for transmitting a pivoting movement of the running-direction operating element to the hydraulic components of the soil compacting apparatus via the hydraulic connection device.

The hydraulic components can be, for example, the unbalance exciter in the vibratory plate or a hydraulic adjustment device in the unbalance exciter. The adjustment device can be coupled in a known manner to the unbalance masses or unbalance shafts in the unbalance exciter and can set or adjust the phase position of the unbalance shafts with respect to one another.

The hydraulic connection device, for example a hydraulic connection or a hydraulic hose, couples the running-direction transmission device to the hydraulic components, for example to the hydraulic adjustment device of the unbalance exciter. For example, the running-direction transmission device can be provided with a hydraulic master cylinder with a movable master piston, the movement of which is coupled to the movement of the running-direction operating element. The master cylinder with the master piston is hydraulically connectable to a slave cylinder/slave piston on the unbalance exciter, for example in the adjustment device of the latter, in order to adjust the relative position and the phase position of the unbalance shafts with respect to one another there in a manner which is known per se.

In this way, the position of the running-direction operating element can be transmitted directly to a position of the hydraulic components and therefore, for example, of the unbalance exciter.

A rotational-speed transmission device can be provided, for transmitting a pivoting position of the rotational-speed operating element to a motor controller of the drive motor. The motor controller is also not part of the control apparatus, but on the contrary part of the drive motor to which the control apparatus according to the invention can be connected.

If the drive motor is an internal combustion engine, the motor controller comprises, for example, a carburetor which can be activated by the rotational-speed operating element with the aid of the rotational-speed transmission device. Of course, the term "rotational-speed transmission device" does not mean here that a rotational speed is transmitted, but rather merely means the control information for bringing about a corresponding rotational speed of the motor. The term has been selected in order to clarify an assignment to the rotational-speed operating element.

The rotational-speed transmission device can permit an electronic transmission. In practice, however, a mechanical transmission, for example with a mechanical Bowden cable which can be designed in a known manner, has proven especially suitable.

At least the following operating states of the soil compacting apparatus can be activated by the running-direction operating element: maximum forward travel, maximum rearward travel, standstill. At a standstill, it is in particular possible here for the soil compacting apparatus to bring about stationary vibrating, i.e. stationary compacting, in order to achieve a particularly intensive soil compaction locally. The corresponding direction of travel or the standstill can be achieved by adjusting the resulting force vector in the unbalance exciter.

The rotational-speed operating element can be pivotable into at least the following positions which correspond to corresponding operating states of the drive motor: maximum position for a maximum rotational speed of the drive motor, idling position for an idling rotational speed of the drive motor. The selection of these positions or operating states makes sense especially if the drive motor is an internal combustion engine.

In one embodiment, an imaginary envelope of the running-direction operating element can circumscribe a virtual space, wherein the rotational-speed operating element is at least partially arranged in the virtual space in a "switched-off" operating state.

The switched-off operating state is a state in which the drive motor, in particular the internal combustion engine, is switched off. The optionally driven soil compacting apparatus is then at a standstill and not in operation.

A "virtual" space is intended to describe a volume which is not restricted on all sides by actual physical boundaries, such as housing walls, panels, etc. On the contrary, this should be understood as meaning the volume which is surrounded by the envelope of the running-direction operating element. The envelope therefore behaves like an imaginary cloth which is stretched over the running-direction operating element.

Owing to the fact that the rotational-speed operating element in the switched-off operating state is at least partially arranged in the virtual space spanned by the running-direction operating element, the rotational-speed operating element is surrounded, i.e. protected, by the running-direction operating element. It is possible here, for example, for the two operating elements to lie in alignment, as viewed from the side. The running-direction operating element which is conventionally configured to be very much more robust is a type of protective bar or protective frame for the rotational-speed operating element. Harmful mechanical effects from the outside can thereby be reliably kept away from the rotational-speed operating element.

In particular, that part of the rotational-speed operating element which extends away from the pivot axis, i.e. the actual lever, is intended to be positioned in the virtual space. By contrast, the hub permitting the pivotability and carrying the actual lever is, for its part, generally of robust configuration and is more rarely exposed to operative actions from the outside.

In the "switched-off" operating state, the running-direction operating element can take up a frontmost pivoting position in particular automatically, i.e. without action of the operator, while, in the "switched-off" operating state, the rotational-speed operating element can take up an idling position. The frontmost pivoting position of the running-direction operating element can correspond to a maximum or full forward travel. Owing to the design, this position can arise by itself, i.e. automatically, because of the action of inertia of the unbalance shafts in the unbalance exciter or a spring in the drawbar head. The inertia action leads to hydraulic forces being exerted via the running-direction transmission device on the running-direction operating element, said hydraulic forces moving the operating element into the frontmost pivoting position for the maximum forward travel as long as the operator does not act to the contrary by manual force.

The rotational-speed operating element should always automatically be in the idling position if the motor is switched off ("switched-off" operating state) in order to facilitate a later starting of the motor. It is expedient in the case of internal combustion engines for the rotational speed lever to be in the idling position during starting of the motor, in order, firstly, to permit a speedy starting operation and, secondly, to avoid revving up of the motor (if the rotational speed lever is, for example, in the full throttle position). In order to ensure the automatic pivoting of the rotational-speed operating element into the idling position, a resetting device which will also be explained below can be provided.

The idling position should be understood as meaning a position of the rotational-speed operating element which brings about an idling rotational speed or idling state of the drive motor or internal combustion engine. If the two operating elements are in the positions mentioned (frontmost pivoting position, idling position), the rotational-speed operating element should, for its part, be in the virtual space spanned by the running-direction operating element, in order to be effectively protected. Since the two positions for the two operating elements are always taken up automatically independently of each other if the soil compacting apparatus is switched off, this protective position is also automatically achieved for the rotational-speed operating element.

A resetting device can be provided, for generating a resetting torque on the rotational-speed operating element when the rotational-speed operating element is rotated by the operator from the idling position into a "switching-off" position, wherein, when the rotational-speed operating element is released by the operator, the resetting device uses the resetting torque to bring about a rotation of the rotational-speed operating element from the switching-off position into the idling position.

The switching-off position is intended to be understood as meaning a position of the rotational-speed operating element in which the internal combustion engine is switched off. This can be, for example, a position in which an electric switching-off device is actuated. It can similarly also be a position in which the rotational speed is reduced via the carburetor to such an extent that the motor comes to a standstill. While the "switched-off" operating state means that the motor is already switched off, the "switching-off" operating state therefore describes a state in which the motor is still intended to be transferred into the "switched-off" operating state.

The resetting device makes it possible for the rotational-speed operating element to use the resetting torque to automatically rotate into the "idling" position whenever the operator has previously rotated the operating element into the "switching-off" position in order to switch off the internal combustion engine. In the "idling" position, the motor is then automatically in the "switched-off" operating state. The operator therefore no longer has to take care to ensure that the rotational-speed operating element is in a suitable position in order to subsequently start the internal combustion engine again in the idling mode.

In order to generate the resetting torque, the resetting device can be designed in a suitable manner and, for example, can have a spring.

The running-direction operating element can be designed as a handlebar, wherein the handlebar can be fastened to a shaft bolt, the center axis of which corresponds to the common pivot axis, and wherein the handlebar can be pivotable together with the shaft bolt about the common pivot axis. The shaft bolt can accordingly be connected rigidly to the handlebar and can form a structural unit therewith. It absorbs the torque which is introduced by the operator with the operator's hand force as the pivoting movement of the handlebar. In addition, the shaft bolt can serve for the stable and pivotable mounting of the handlebar on the drawbar head.

The shaft bolt can be coupled here to the running-direction transmission device in order to transmit the pivoting movement of the running-direction operating element, for example a handlebar, and therefore of the shaft bolt, to the hydraulic component of the soil compacting apparatus, which hydraulic component can be coupled to the control apparatus. The pivoting torque applied by the operator can therefore finally be transmitted via the shaft bolt and the running-direction transmission device to the unbalance exciter of the vibration plate.

The rotational-speed operating element can be coupled to a bearing drum which is mounted in the control housing and is rotatable in a manner corresponding to a movement of the rotational-speed operating element. The bearing drum, for is part, can likewise be rotatable about the common pivot axis, wherein the rotational-speed transmission device can be designed to transmit a rotational position of the bearing drum to the motor controller of the internal combustion engine. The motor controller here is not part of the control apparatus, but rather can be assigned to the drive motor.

The operator can therefore actuate the rotational-speed operating element by pivoting the latter. This pivoting movement is transmitted directly via the rotational-speed operating element to the bearing drum which is coupled rigidly to the rotational-speed operating element. The rotational movement of the bearing drum can be transmitted by the rotational-speed transmission device, thus, for example, via a Bowden cable, to the motor controller of the internal combustion engine, for example to a carburetor, in order to set the desired rotational speed of the motor there.

The bearing drum can be at least partially designed as a sleeve which surrounds the shaft bolt of the running-direction operating element or of the handlebar on the circumference.

In this case, the bearing drum can be mounted at its outer circumference in the control housing with the aid of one or more suitable plain bearings. In addition, the shaft bolt can be mounted in the control housing, likewise with the aid of one or more plain bearings. The bearings for the bearing drum and for the shaft bolt can therefore be arranged next to one another in the control housing. A gap can be formed between the inner side of the bearing drum and the shaft bolt penetrating the bearing drum, in order to separate the mounting of the shaft bolt from the mounting of the bearing drum.

A starting operating device can be provided, for activating a starter apparatus, which can be coupled to the control apparatus, for the internal combustion engine upon actuation by an operator, wherein a covering device which is coupled to the rotational-speed operating element can be provided, for covering the starting operating device depending on a position of the rotational-speed operating element.

The starting operating device can be, for example, a button or switch with which the starter apparatus (for example an electric starter) can be activated. If the operator presses the button, the starter is started.

The covering device is coupled to the rotational-speed operating element, for example to the rotational speed lever, and then covers the starting operating device if the intention is to prevent an inadvertent actuation of the starting operating device by the operator. The starting operating device is then not accessible to the operator by the operator's fingers.

Only if starting of the motor is permitted, for example in the idling position, does the covering device release the starting operating device because of the position which the rotational-speed operating element is then in, and therefore said starting operating device can be actuated by the operator.

The rotational-speed operating element can be coupled to the covering device in such a manner that the starting operating device is covered by the covering device if the rotational-speed operating element is in a position which brings about a rotational speed of the drive motor greater than the idling rotational speed. An inadvertent actuation of the starting operating device can therefore also be prevented, which could then be damaging in particular if the motor is already running at a high rotational speed.

The described control apparatus can advantageously be used, in particular, in the case of a vibratory plate serving as a soil compacting apparatus.

The effect which can be achieved with the described control apparatus is that the rotational-speed operating element, for example the rotational speed lever, is readily accessible and can easily be operated by an operator. Owing to the fact that the rotational speed lever is arranged close to the handlebar serving as the running-direction operating element, rapid access can be achieved even if the machine is guided only with one hand. Spontaneous changes in rotational speed are therefore possible in order, for example, to bring about a short-term reduction in rotational speed (and therefore also a reduction in the centrifugal force and in the running speed of the vibratory plate) in front of a sensitive object, for example a protruding shaft ring made of concrete. The rotational speed lever and a pictogram, which is optionally arranged with respect thereto, for clarifying the different rotational speed positions can be seen better here than if it were arranged at another location on the drawbar body. The operator can immediately reach the handle of the rotational speed lever without having to edge toward it.

The rotational speed lever is well protected against physical damage since it does not project freely into the unprotected space. Specifically physical damage during the loading of a vibratory plate can thus be avoided. This applies in particular if the handlebar and the rotational speed lever are aligned, and therefore the full protective action of the handlebar can be used.

In addition, the covering of the starter button may be useful. If a rotational speed lying above the idling rotational speed is then set at the rotational speed lever, the electric button for actuating the starter is partially covered or completely covered, which signals to the operator not to actuate the button. Depending on the configuration, the operator then also does not have any opportunity of actuating the button. This prevents the motor from being inadvertently started at an increased rotational speed. Coupling of an optionally present centrifugal force clutch can thereby also be prevented, and therefore the machine is not inadvertently and unexpectedly set into motion.

BRIEF DESCRIPTION OF THE DRAWINGS

These and further advantages and features of the invention will be explained in more detail below using examples with reference to the accompanying figures, in which.

DETAILED DESCRIPTION

Figure 1:
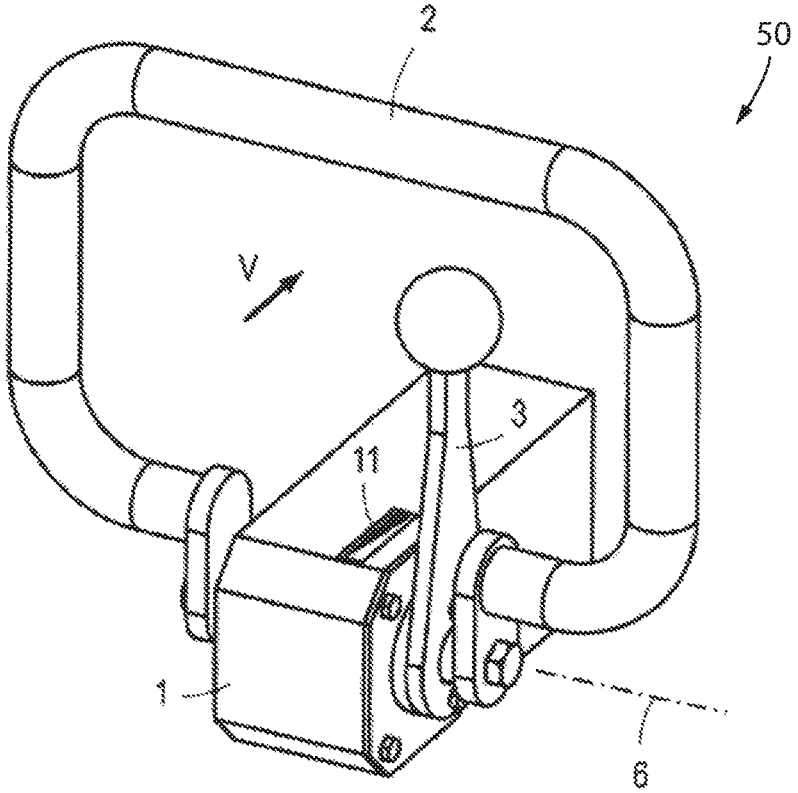
FIG. 1 shows, in a perspective view, a control apparatus according to the invention for a soil compacting apparatus.
Figure 2:
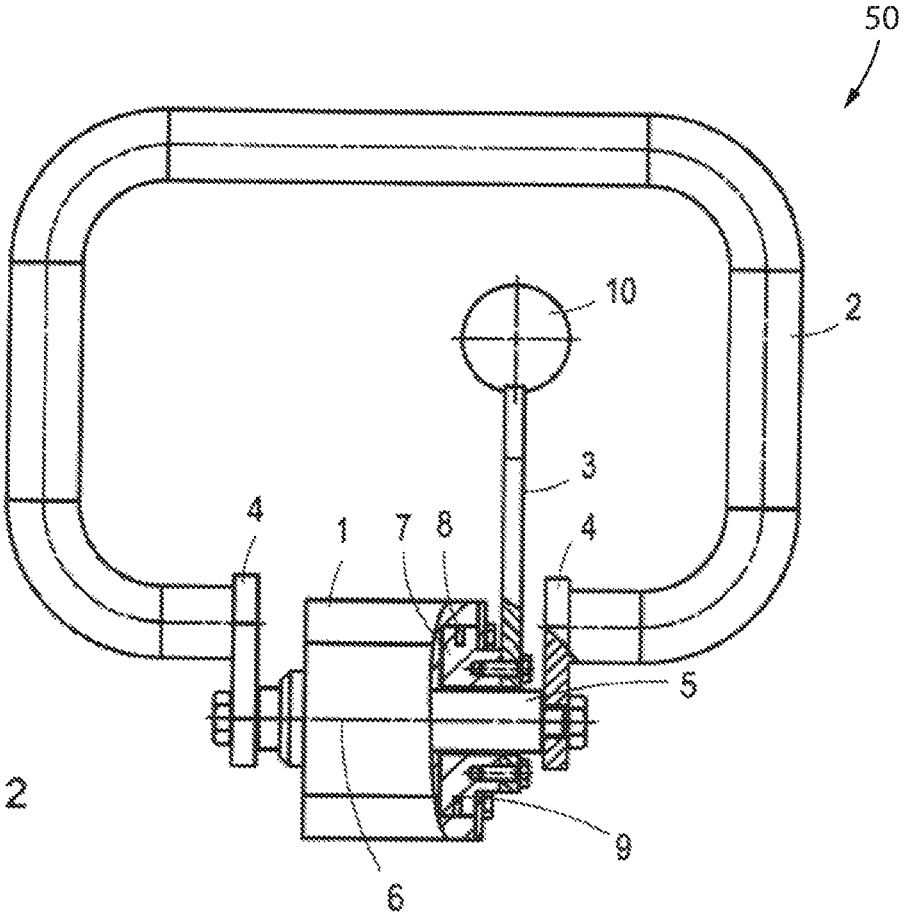
FIG. 2 shows the control apparatus from FIG. 1 in a partial sectional illustration.

FIGS. 1 and 2 show a control apparatus 50 for a soil compacting apparatus, in particular for a vibratory plate.

Figure 5:
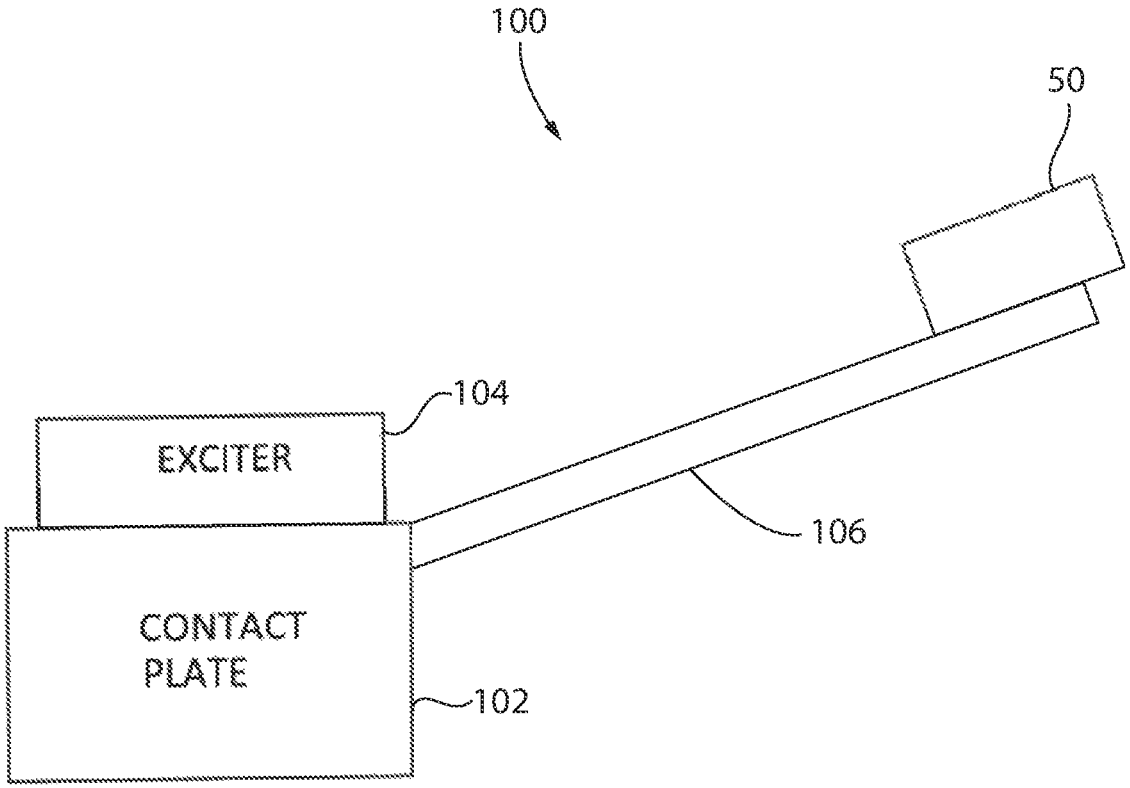
FIG. 5 schematically shows a vibratory plate fitted with the control apparatus of FIGS. 1 and 2

The control apparatus 50 is arranged in or on a control housing 1 which can be designed at the same time as a drawbar head which, in turn, is arranged at the end of a guide drawbar 106 of a vibratory plate 100 as schematically shown in FIG. 5. The vibratory plate 100 includes a soil contact plate 102, on which an unbalance exciter 104 is mounted which, for example, has two eccentric shafts which can be rotated in opposite directions and can be set in opposed rotation by a drive. The control apparatus 50 is provided at a free end of the drawbar 106 and forms a drawbar head.

Referring again to FIGS. 1 and 2, two operating elements are provided on the control housing 1. The operating elements are a handlebar 2 (switchover handle) serving as running-direction operating element, and a rotational speed lever 3 serving as a rotational-speed operating element.

The handlebar 2 is configured robustly and has a substantially rectangular shape in front view (FIG. 2), wherein the corners are rounded. The handlebar 2 is generally manufactured from a stable, curved tube, to the ends of which two sheet-metal tabs 4 are welded, the ends of which in turn are screwed to each other via a shaft bolt 5. The shaft bolt 5 is mounted in a suitable manner in the control housing 1. The handlebar 2 with the sheet-metal tabs 4 and the shaft bolt 5 therefore forms a closed encircling form which increases the stability.

When the handlebar 2 is actuated, the latter therefore pivots with the sheet-metal tabs 4 and the shaft bolt 5 about a pivot axis 6 serving as the first axis.

The shaft bolt 5 is coupled to a running-direction transmission device, not illustrated. This can have, for example, a pinion which is fastened to the shaft bolt 5 and, via a rack, shifts a master piston in a master cylinder axially to and fro. Via a hydraulic coupling, the resulting hydraulic signal is transmitted to a slave piston in a slave cylinder which can be provided in the vibratory plate on an unbalance exciter. The unbalance shafts in the unbalance exciter can be adjusted in respect of their rotational position or phase position with the aid of the slave piston in order to adjust the direction of the force vector resulting during rotation of the two unbalance shafts relative to each other. The running direction of the vibratory plate can thereby be influenced. In particular, running directions with a maximum forward travel, maximum rearward travel and at standstill of the vibratory plate can therefore be achieved, wherein any desired intermediate positions are also possible. The positions correspond here to a respective pivoting position of the handlebar 2 relative to the control housing 1.

The described principle for activating hand-guided vibratory plates is well known and therefore does not need to be explained in more detail at this juncture.

By contrast, a new feature is that the rotational speed lever 3 is also mounted on the control housing 1 coaxially with respect to the handlebar 2.

For this purpose, the rotational speed lever 3 is coupled rigidly or screwed fixedly to a bearing drum 7. The bearing drum 7 is mounted captively and rotatably in the control housing 1, in particular with the aid of a plain bearing formed on the outer circumference of the bearing drum 7. At its outside diameter, the bearing drum 7 has an encircling recess 8 in which a wire 9 of a Bowden cable is guided.

By rotation of the rotational speed lever 3 and therefore of the bearing drum 7, the wire 9 of the Bowden cable is thereby wound up to a greater or lesser extent, that is to say is tightened or released. The other end of the wire 9 and of the Bowden cable, not illustrated, is coupled to a carburetor of an internal combustion engine belonging to the vibratory plate. The position of a throttle valve in the carburetor can thereby be adjusted via the Bowden cable and the wire 9 by pivoting of the rotational speed lever 3. Alternatively, the Bowden cable can also act on a different regulating device, such as, for example, an injection pump in the case of diesel engines.

The rotational speed lever 3 with the bearing drum 7 is likewise pivotable about the pivot axis 6 which to this extent also serves as the second axis. The pivot axis 6 is therefore a common pivot axis both for the rotational speed lever 3 and for the handlebar 2. A highly compact design of the control apparatus is thereby possible.

As FIG. 2 shows, the handlebar 2 is mounted in the left part of the control housing 1 via the shaft bolt 5, for example with the aid of a plain bearing, not illustrated. The bearing drum 7 is mounted directly next to it, in the right part of the control housing 1. The shaft bolt 5 extends through the hollow-cylindrical, sleeve-like bearing drum 7 without touching the latter. The mountings of handlebar 2 and rotational speed lever 3 can thereby be readily separated from each other in order to prevent them undesirably influencing each other.

In addition, FIGS. 1 and 2 show that the handlebar 2 extends in a protective manner around the rotational speed lever 3. The handlebar 2 provides a type of protective frame around the rotational speed lever 3. The rotational speed lever 3 and the handlebar 2 are aligned, as viewed from the side, as is also apparent from FIGS. 1 and 2.

As a result, the rotational speed lever 3 which is configured to be overall weaker and more sensitive and is equipped with a knob 10 at its end can be effectively protected by the handlebar 2 against mechanical actions from the outside.

The position of the handlebar 2 and of the rotational speed lever 3 that is shown in FIGS. 1 and 2 corresponds to a position which the two operating elements automatically take up when the internal combustion engine and therefore the vibratory plate are switched off. This therefore also involves the position with which the vibratory plate is, for example, transported and loaded.

In particular, the handlebar 2 in this case is in its frontmost pivoting position (arrow direction V) which takes place automatically owing to the action of inertia of the unbalance masses in the unbalance exciter and the transmission via the hydraulics to the handlebar 2. If the operator releases the handlebar 2, the frontmost position (maximum forward travel) shown in FIGS. 1 and 2 arises automatically.

The rotational speed lever 3 is also in a position which arises automatically when the motor is switched off. This is in particular the idling position which is also expedient if the motor is intended to be started again.

A resetting device, not illustrated, which automatically pivots the rotational speed lever 3 into the shown idling position can optionally be provided. For example, in order to switch off the internal combustion engine, a switching-off position can be taken up by the rotational speed lever 3 and the bearing drum 7, in which the rotational speed lever 3 is pivoted out of the idling position shown in FIG. 1 counter to the arrow direction V. In this case, for example, an electric switching-off contact can be actuated which electrically switches off the internal combustion engine. The rotational speed can thereby also be reduced to such an extent that the internal combustion engine comes to a standstill. As soon as the operator releases the rotational speed lever 3, the resetting device causes the rotational speed lever 3 and the bearing drum 7 to pivot in the arrow direction V into the idling position shown in FIGS. 1 and 2. The rotational speed lever 3 is then readily protected by the handlebar 2 in this position.

For simpler operation of the rotational speed lever 3, a pictogram 11 can be provided on the upper side of the control housing 1, the pictogram clarifying the "idling rotational speed" and "maximum rotational speed" positions by means of a simple symbolic illustration.

Figure 3:
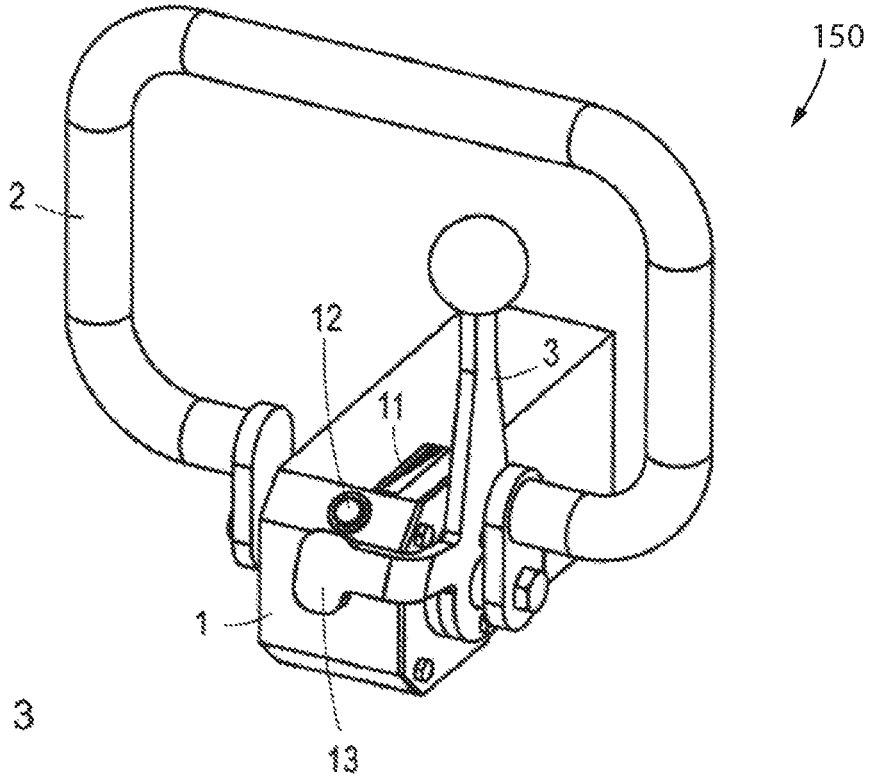
FIG. 3 shows a variant of the control apparatus in a perspective view.
Figure 4:
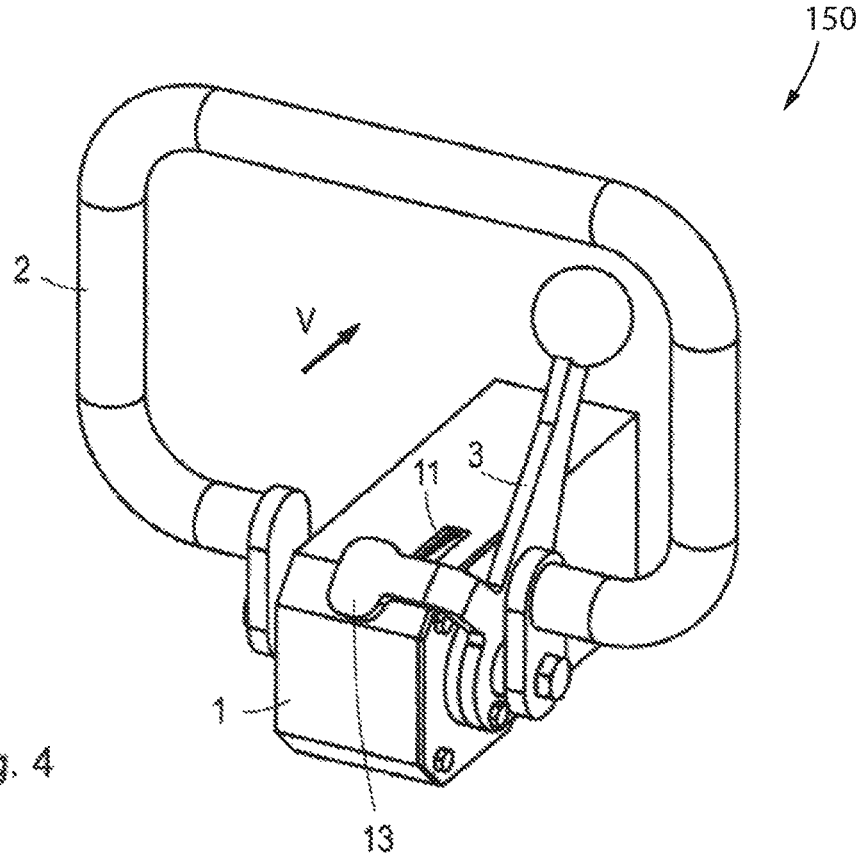
FIG. 4 shows the control apparatus from FIG. 3 in another operating state.

FIGS. 3 and 4 shows a variant in which the control apparatus 150 that can be fitted on the vibratory plate 100 of FIG. 5. In addition to incorporating the components of the control apparatus of FIGS. 1 and 2, control apparatus is additionally equipped with a starting button 12 serving as starting operating device (FIG. 3). By actuation of the starting button 12, the operator can activate a starter which starts the internal combustion engine in the known manner.

The starting button 12 is readily accessible in FIG. 3 and can be easily actuated by the operator.

However, a covering 13 is formed on the rotational speed lever 3, said covering, in the example shown in FIGS. 3 and 4, being connected integrally to the rotational speed lever 3. It can, of course, also be coupled to the rotational speed lever 3 in a different way.

In the position shown in FIG. 4, the rotational speed lever 3 is pivoted forward in the arrow direction V, as a result of which the covering 13 is pivoted via the starting button 12. In this state, the rotational speed of the internal combustion engine is increased relative to the idling mode via the rotational speed lever 3 and may also correspond, for example, to a maximum rotational speed. It would then be extremely damaging for the starter (electric starter) if it were accidentally activated once again by the operator by actuating the starting button 12.

In order to prevent this, the covering 13 is pivoted over the starting button 12 such that the latter is no longer accessible and also cannot be inadvertently actuated by the operator

We claim:

1. A control apparatus for a soil compacting apparatus which can be driven by a drive motor, comprising:

a running-direction operating element, which is pivotable about a first axis for predetermining a running direction of the soil compacting apparatus by an operator; and a rotational-speed operating element, which is pivotable about a second axis, for setting a rotational speed of the drive motor;

wherein the first axis and the second axis are congruent and form a common pivot axis.

2. The control apparatus as claimed in claim 1, wherein the running-direction operating element and the rotational-speed operating element are held by a control housing.

3. The control apparatus as claimed in claim 1, wherein a hydraulic connection device is provided, to which hydraulic components of the soil compacting apparatus can be connected; and wherein the running-direction operating element is coupled to a running-direction transmission device for transmitting a pivoting movement of the running-direction operating element to the hydraulic components of the soil compacting apparatus via the hydraulic connection device.

4. The control apparatus as claimed in claim 1, wherein a rotational-speed transmission device is provided for transmitting a pivoting position of the rotational-speed operating element to a motor controller of the drive motor.

5. The control apparatus as claimed in claim 1, wherein at least the following operating states of the soil compacting apparatus can be activated by the running-direction operating element:

maximum forward travel of the soil compacting apparatus;

maximum rearward travel of the soil compacting apparatus; and standstill of the soil compacting apparatus.

6. The control apparatus as claimed in claim 1, wherein the rotational-speed operating element can be pivoted into at least the following positions which correspond to corresponding operating states of the drive motor:

maximum position for a maximum rotational speed of the drive motor; and idling position for an idling rotational speed of the drive motor.

7. The control apparatus as claimed in claim 1, wherein an envelope of the running-direction operating element circumscribes a virtual space; and wherein the rotational-speed operating element is at least partially arranged in the virtual space in a "switched-off" operating state thereof.

8. The control apparatus as claimed in claim 1, wherein the running-direction operating element takes up a frontmost pivoting position in the "switched-off" operating state thereof; and wherein the rotational-speed operating element takes up an idling position in the "switched-off" operating state thereof.

9. The control apparatus as claimed in claim 1, wherein a resetting device is provided for generating a resetting torque on the rotational-speed operating element when the rotational-speed operating element is rotated by the operator from the idling position into a switching-off position; and wherein when the rotational-speed operating element is released by the operator, the resetting device uses the resetting torque to bring about a rotation of the rotational-speed operating element from the switching-off position into the idling position.

10. The control apparatus as claimed in claim 1, wherein the running-direction operating element comprises a handlebar;

the handlebar is fastened to a shaft bolt, the center axis of which corresponds to the common pivot axis; and wherein the handlebar can be pivoted together with the shaft bolt about the common pivot axis.

11. The control apparatus as claimed in claim 4, wherein the rotational-speed operating element is coupled to a bearing drum which is mounted in the control housing and which can be rotated in a manner corresponding to a movement of the rotational-speed operating element; wherein the bearing drum is rotatable about the common pivot axis; and wherein the rotational-speed transmission device is designed to transmit a rotational position of the bearing drum to the motor controller of the drive motor.

12. The control apparatus as claimed in claim 11, wherein the bearing drum includes a sleeve which surrounds the shaft bolt on the circumference.

13. The control apparatus as claimed in claim 1, wherein a starting operating device is provided for activating a starter apparatus which can be coupled to the control apparatus and which can start the drive motor upon actuation by an operator; and wherein a covering device which is coupled to the rotational-speed operating element is provided for covering the starting operating device depending on a position of the rotational-speed operating element.

14. The control apparatus as claimed in claim 13, wherein the rotational-speed operating element is coupled to the covering device in such a manner that the starting operating device is covered by the covering device if the rotational-speed operating element is in a position which brings about a rotational speed of the drive motor greater than the idling rotational speed.

15. A vibratory plate comprising:

a soil contact plate, an unbalance exciter mounted on the soil contact plate;

a longitudinally extending drawbar provided on the vibratory plate and having a free end, a control apparatus provided on the free end of the drawbar, the control apparatus including a running-direction operating element, which is pivotable about a first axis, for predetermining a running direction of the soil compacting apparatus by an operator; and a rotational-speed operating element, which is pivotable about a second axis, for setting a rotational speed of the drive motor; wherein the first axis and the second axis are congruent and form a common pivot axis.

* * * * *